US009587802B2

(12) United States Patent
Chen et al.

(10) Patent No.: US 9,587,802 B2
(45) Date of Patent: Mar. 7, 2017

(54) LED ASSEMBLY HAVING A REFRACTOR THAT PROVIDES IMPROVED LIGHT CONTROL

(71) Applicant: ABL IP HOLDING LLC, Conyers, GA (US)

(72) Inventors: Jie Chen, Snellville, GA (US); Craig Eugene Marquardt, Covington, GA (US); Daniel Aaron Weiss, Tucker, GA (US); Daniel Vincent Sekowski, Loganville, GA (US); Yaser S. Abdelsamed, Granville, OH (US)

(73) Assignee: ABL IP Holding LLC, Decatur, GA (US)

( * ) Notice: Subject to any disclaimer, the term of this patent is extended or adjusted under 35 U.S.C. 154(b) by 0 days.

(21) Appl. No.: 14/693,193

(22) Filed: Apr. 22, 2015

(65) Prior Publication Data

US 2015/0226404 A1 Aug. 13, 2015

Related U.S. Application Data

(63) Continuation of application No. 13/837,731, filed on Mar. 15, 2013, now Pat. No. 9,080,746.

(51) Int. Cl.
*F21V 7/00* (2006.01)
*F21V 13/04* (2006.01)
(Continued)

(52) U.S. Cl.
CPC ..... *F21V 13/04* (2013.01); *F21V 5/04* (2013.01); *F21V 5/08* (2013.01); *F21V 23/004* (2013.01);
(Continued)

(58) Field of Classification Search
CPC ..... F21V 13/04; F21V 23/004; F21V 5/04; F21V 5/08; F21W 2131/10; F21Y 2101/02
See application file for complete search history.

(56) References Cited

U.S. PATENT DOCUMENTS 1,551,274 A 8/1925 Townsend
2,170,912 A 8/1939 Rolph
(Continued)

FOREIGN PATENT DOCUMENTS

JP 2004/288866 10/2004
WO 2010019810 2/2010
(Continued)

OTHER PUBLICATIONS

Non-Final Office Action for U.S. Appl. No. 13/837,731 mailed on Jun. 13, 2014 10 pages.
(Continued)

*Primary Examiner* — Donald Raleigh
(74) *Attorney, Agent, or Firm* — Kilpatrick Townsend & Stockton, LLP

(57) ABSTRACT

An LED assembly that includes optics and optical arrangements for light emitting diodes (LEDs). In some embodiments, a reflector is provided within a void between the lens and the LED. This reflector can reflect light emitted by the LED in a non-preferred direction back toward the preferred direction. In other embodiments, an optical element is formed or otherwise provided in the lens cavity and shaped so that, when the lens is positioned above the LED, the refractor bends the emitted light in a preferred direction. In some embodiments, both a reflector and optical element are provided in the LED assembly to control the directionality of the emitted light. Such embodiments of the invention can
(Continued)

be used to increase the efficiency of an LED by ensuring that generated light is being directed to the target area of choice.

20 Claims, 15 Drawing Sheets

(51) Int. Cl.

| | |
|---|---|
| ***F21V 5/04*** | (2006.01) |
| ***F21V 5/08*** | (2006.01) |
| ***F21V 23/00*** | (2015.01) |
| *F21W 131/10* | (2006.01) |
| *F21Y 101/00* | (2016.01) |

(52) U.S. Cl.
CPC ..... *F21W 2131/10* (2013.01); *F21Y 2101/00* (2013.01)

(56) References Cited

U.S. PATENT DOCUMENTS

| | | | | |
|---|---|---|---|---|
| 2,662,165 | A | 12/1953 | Franck | |
| 3,191,022 | A | 6/1965 | Wince | |
| 3,278,743 | A | 10/1966 | Franck | |
| 3,283,140 | A | 11/1966 | Rex | |
| 3,340,393 | A | 9/1967 | Franck et al. | |
| 3,459,936 | A | 8/1969 | Miller | |
| 3,524,051 | A | 8/1970 | Baldwin et al. | |
| 3,679,889 | A | 7/1972 | Franck | |
| 3,766,375 | A | 10/1973 | Edman et al. | |
| 4,085,318 | A | 4/1978 | Odle et al. | |
| 4,451,875 | A | 5/1984 | Odle et al. | |
| 5,130,761 | A | 7/1992 | Tanaka | |
| 5,481,445 | A | 1/1996 | Sitzema et al. | |
| 5,929,788 | A | 7/1999 | Vukosic | |
| 6,095,663 | A | 8/2000 | Pond et al. | |
| 6,971,772 | B1 | 12/2005 | Abdelsamed et al. | |
| 7,055,996 | B2 | 6/2006 | Pond et al. | |
| 7,245,203 | B2 | 7/2007 | Stephens et al. | |
| 7,347,586 | B2 | 3/2008 | Izardel | |
| 7,445,359 | B2 | 11/2008 | Chang | |
| 7,445,362 | B2 | 11/2008 | Compton et al. | |
| 7,566,911 | B2 | 7/2009 | Jyo | |
| 7,798,678 | B2 | 9/2010 | Destain | |
| 7,854,536 | B2 | 12/2010 | Holder et al. | |
| 7,896,532 | B2 | 3/2011 | Hsu et al. | |
| 7,959,326 | B2 | 6/2011 | Laporte | |
| 8,167,463 | B2 | 5/2012 | Loh | |
| 8,267,553 | B2 | 9/2012 | Liang et al. | |
| 8,348,475 | B2 | 1/2013 | Wilcox | |
| 8,434,912 | B2 | 5/2013 | Holder et al. | |
| 8,439,525 | B2 | 5/2013 | Abdelsamed et al. | |
| 8,511,864 | B2 | 8/2013 | Holder et al. | |
| 8,628,222 | B2 | 1/2014 | Kelley | |
| 9,080,746 | B2 | 7/2015 | Chen et al. | |
| 9,140,430 | B2 * | 9/2015 | Broughton | F21V 13/04 |
| 2003/0063476 | A1 | 4/2003 | English et al. | |
| 2006/0072314 | A1 | 4/2006 | Rains | |
| 2007/0019416 | A1 * | 1/2007 | Han | H01L 33/58 362/307 |
| 2007/0242441 | A1 | 10/2007 | Aldrich | |
| 2007/0284592 | A1 | 12/2007 | Haase | |
| 2008/0239722 | A1 | 10/2008 | Wilcox | |
| 2009/0225551 | A1 | 9/2009 | Chang et al. | |
| 2009/0295266 | A1 | 12/2009 | Ramer et al. | |
| 2009/0316384 | A1 * | 12/2009 | Kanayama | F21V 7/0025 362/84 |
| 2010/0014290 | A1 | 1/2010 | Wilcox et al. | |
| 2010/0033985 | A1 | 2/2010 | Hsu et al. | |
| 2010/0039810 | A1 * | 2/2010 | Holder | F21V 5/04 362/235 |
| 2010/0302786 | A1 | 12/2010 | Wilcox et al. | |
| 2011/0089453 | A1 | 4/2011 | Min | |
| 2011/0141734 | A1 | 6/2011 | Li et al. | |
| 2011/0215721 | A1 | 9/2011 | Rains, Jr. et al. | |
| 2011/0228528 | A1 * | 9/2011 | Yang | F21V 5/04 362/235 |
| 2011/0292655 | A1 * | 12/2011 | Ing | G09F 13/14 362/241 |
| 2012/0002412 | A1 * | 1/2012 | Cheng | F21S 2/005 362/235 |
| 2012/0026732 | A1 | 2/2012 | Fricke | |
| 2012/0050889 | A1 | 3/2012 | Lu et al. | |
| 2012/0195040 | A1 | 8/2012 | Treanton | |
| 2012/0212138 | A1 | 8/2012 | Jungwirth et al. | |
| 2012/0287649 | A1 * | 11/2012 | Kelley | F21V 5/002 362/335 |
| 2012/0300488 | A1 | 11/2012 | Broughton | |
| 2012/0307503 | A1 * | 12/2012 | Wilcox | F21V 5/008 362/308 |
| 2012/0316384 | A1 | 12/2012 | Arnold | |
| 2013/0250581 | A1 * | 9/2013 | Tang | G02B 19/0028 362/311.02 |
| 2014/0085905 | A1 * | 3/2014 | Broughton | F21V 13/04 362/310 |

FOREIGN PATENT DOCUMENTS

| | | |
|---|---|---|
| WO | WO 2011/100756 | 8/2011 |
| WO | 2012118828 | 9/2012 |
| WO | WO 2014/145802 | 9/2014 |
| WO | 2014145802 A3 | 12/2014 |

OTHER PUBLICATIONS

Final Office Action for U.S. Appl. No. 13/838,139 mailed Jan. 21, 2015 27 pages.
Amendment for U.S. Appl. No. 13/838,139, filed Nov. 20, 2014.
Non-Final Office Action for U.S. Appl. No. 13/838,139 mailed Jun. 20, 2014.
International Search Report and Written Opinion for application No. PCT/US2014/030628 mailed Oct. 14, 2014 11 Pages.
Notice of Allowance for U.S. Appl. No. 13/837,731 mailed May 22, 2015.
Response for U.S. Appl. No. 13/837,731 mailed Sep. 15, 2014.
Applicant-Initiated Interview Summary for U.S. Appl. No. 13/837,731 mailed Sep. 5, 2014.
Extended European Search Report for European Patent Application No. EP 14765038.6, mailed Jul. 21, 2016, 8 pages.

* cited by examiner

LED ASSEMBLY HAVING A REFRACTOR THAT PROVIDES IMPROVED LIGHT CONTROL

CROSS-REFERENCES TO RELATED APPLICATIONS

This application is a continuation of U.S. patent application Ser. No. 13/837,731, filed Mar. 15, 2013, which is hereby incorporated by reference in its entirety for all purposes.

BACKGROUND

Light emitting diodes (LEDs) are used in a variety of general lighting applications such as streetlights, parking garage lighting, and parking lots. LEDs have reached efficiency values per watt that outpace almost all traditional light sources. LEDs, however, can be expensive in lumens per dollar compared to light sources. Because of the high cost of using LEDs, optical, electronic and thermal efficiencies can be very important. In direction lighting applications, such as street lighting, it is inefficient to illuminate the house side of the street rather than direct all the light toward the street. Total internal reflection (TIR) lenses have been used to successfully direct house-side light toward the street. But these TIR solutions are still not very efficient.

BRIEF SUMMARY

This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

Embodiments of the invention include an LED assembly that includes optics and optical arrangements for light emitting diodes (LEDs). In some embodiments, a reflector is provided within a void between the lens and the LED. This reflector can reflect light emitted by the LED in a non-preferred direction back toward the preferred direction. In other embodiments, an optical element is formed or otherwise provided in the lens cavity and shaped so that, when the lens is positioned above the LED, the refractor bends the emitted light in a preferred direction. In some embodiments, both a reflector and optical element are provided in the LED assembly to control the directionality of the emitted light. Such embodiments of the invention can be used to increase the efficiency of an LED by ensuring that generated light is being directed to the target area of choice.

BRIEF DESCRIPTION OF THE DRAWINGS

Illustrative embodiments of the present invention are described in detail below with reference to the following drawing figures.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the invention include an LED assembly that includes optics and optical arrangements for light emitting diodes (LEDs). In some embodiments, a reflector is provided within a void between the lens and the LED. This reflector can reflect light emitted by the LED in a non-preferred direction back toward the preferred direction. In other embodiments, an optical element is formed or otherwise provided in the lens cavity and shaped so that, when the lens is positioned above the LED, the refractor bends the emitted light in a preferred direction. In some embodiments, both a reflector and optical element are provided in the LED assembly to control the directionality of the emitted light. Such embodiments of the invention can be used to increase the efficiency of an LED by ensuring that generated light is being directed to the target area of choice.

Figure 1:
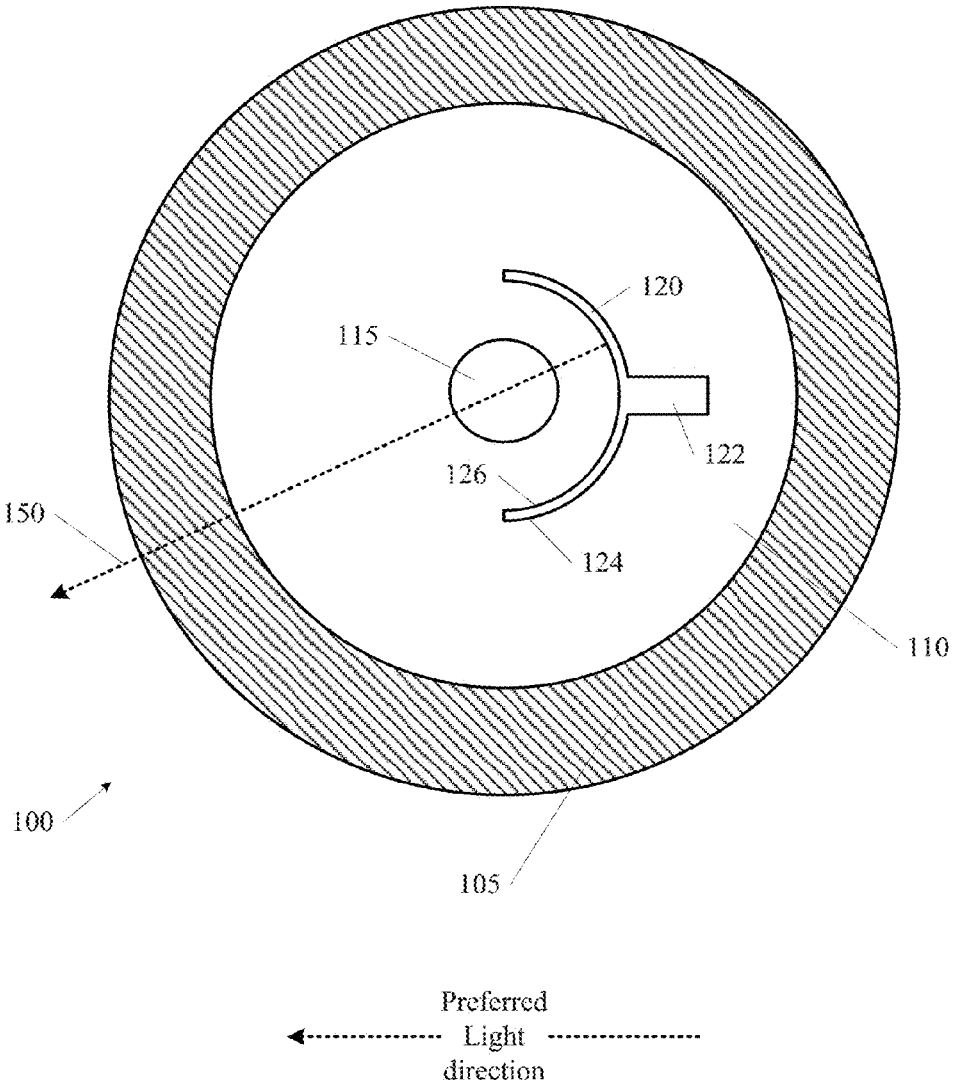
FIG. 1 shows a cross-section of one embodiment of an LED assembly.
Figure 2:
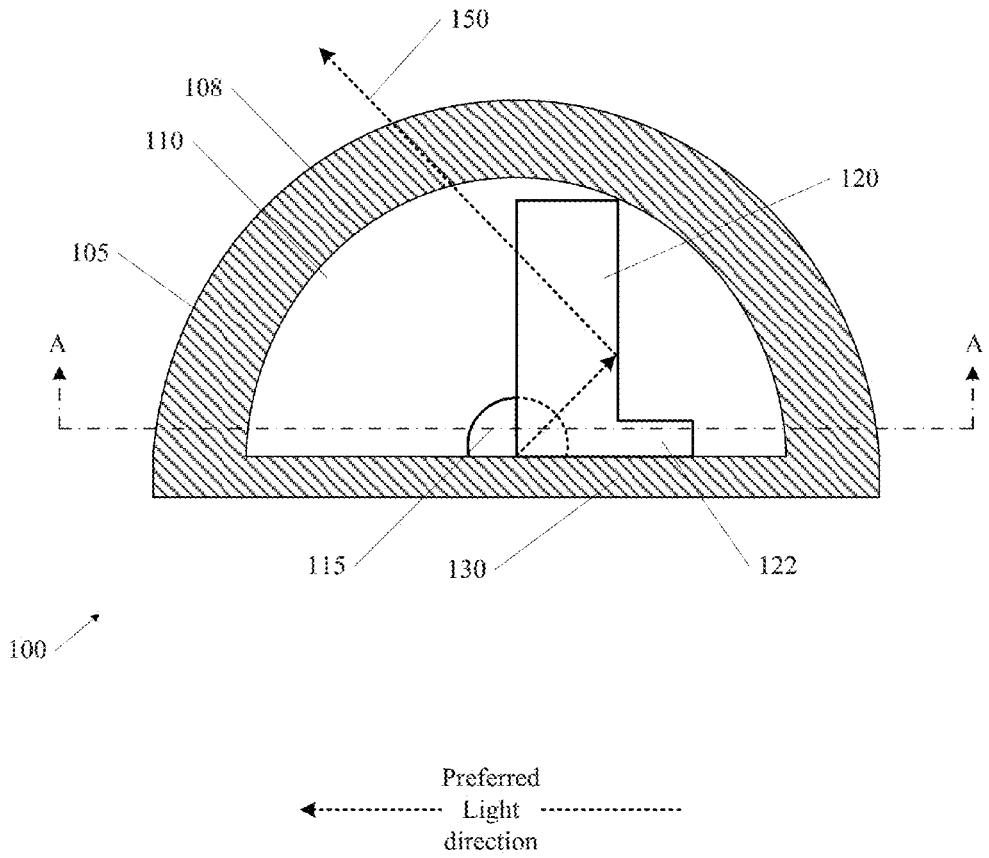
FIG. 2 shows another cross-section of the LED assembly of FIG. 1.
Figure 3:
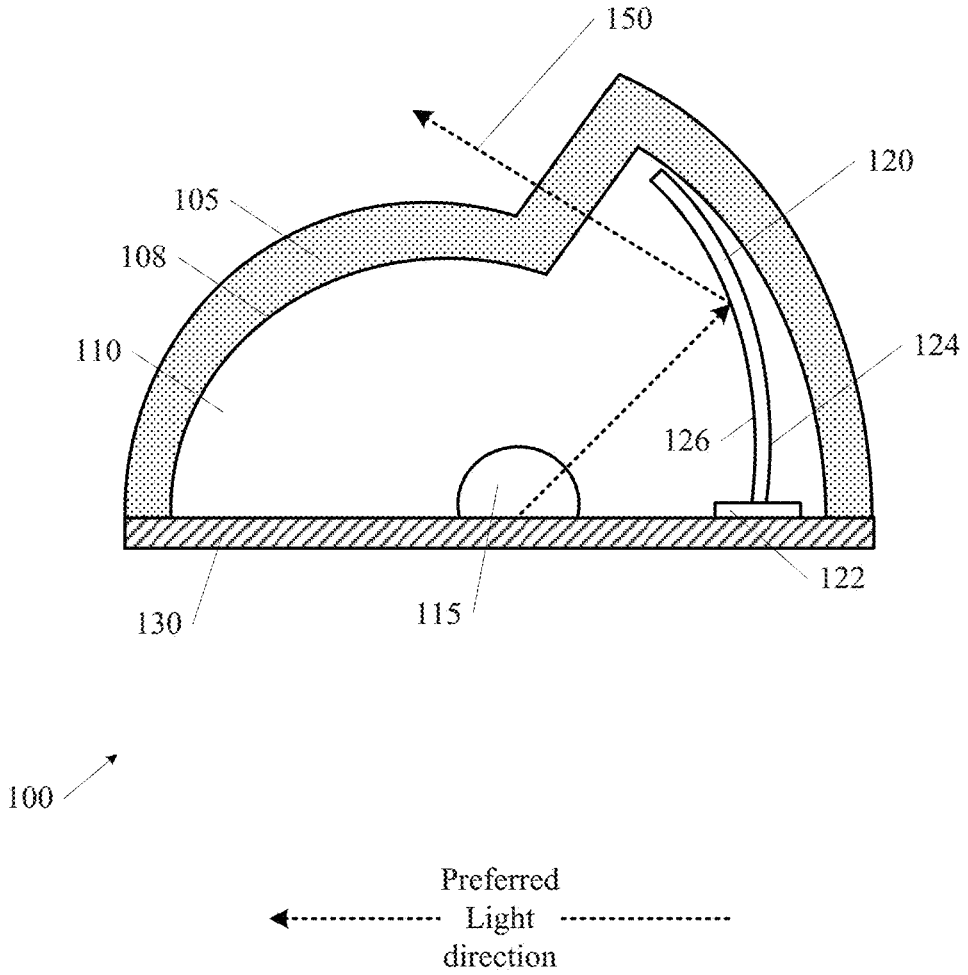
FIG. 3 shows a cross-section of an alternative embodiment of an LED assembly.
Figure 4:
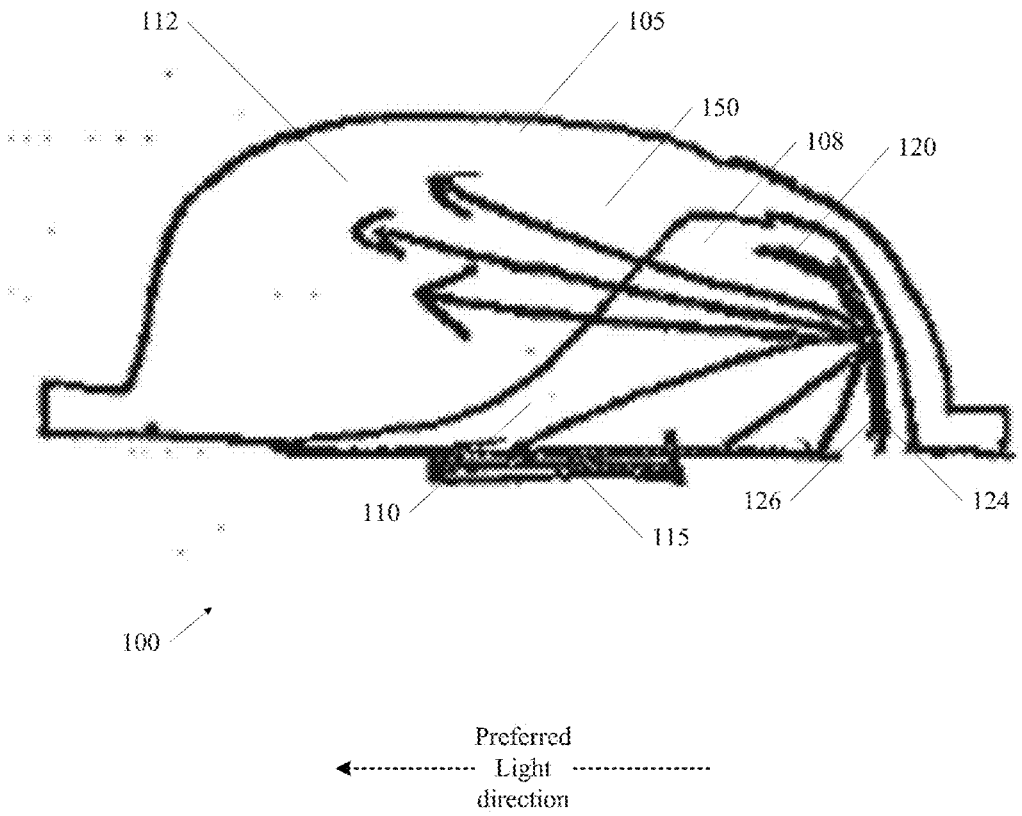
FIG. 4 shows a cross-section of yet another alternative embodiment of an LED assembly.

FIG. 1 shows a top view of an LED assembly 100 cut along line A-A of the cross-sectional view of LED assembly 100 shown in FIG. 2. Referring to both these figures, LED assembly 100 can include light emitter 115 disposed within lens 105 such that a void 110 exists between the lens 105 and light emitter 115 and surrounds light emitter 115. In some embodiments, void 110 can be semi-hemispherical, but void 110 is certainly not intended to be limited to this geometry. Rather, the inner surface 108 of the lens 105, and thus the shape of void 110 dictated by such inner surface 108, can be of any desired shape. For example, FIG. 3 illustrates another embodiment of the LED assembly 100 where the inner surface 108 of the lens 105 is not semi-hemispherical. FIG. 4 illustrates a cross-section of another embodiment of LED assembly 100 where the inner surface 108 of lens 105 is shaped so as to create a thick lens portion 1120.

Light emitter 115 can be any type of light emitter known in the art. For example, light emitter 115 can include a light emitter made from Aluminum gallium arsenide (AlGaAs), Gallium arsenide phosphide (GaAsP), Aluminum gallium indium phosphide (AlGaInP), Gallium(III) phosphide (GaP), Aluminum gallium phosphide (AlGaP), Zinc selenide (ZnSe), Indium gallium nitride (InGaN), Silicon carbide (SiC) Silicon (Si), or Indium gallium nitride (InGaN).

In some embodiments, lens 105 can include plastic, glass, silicon, epoxy, or acrylic material. These materials may or may not be optical grade.

Figure 5:
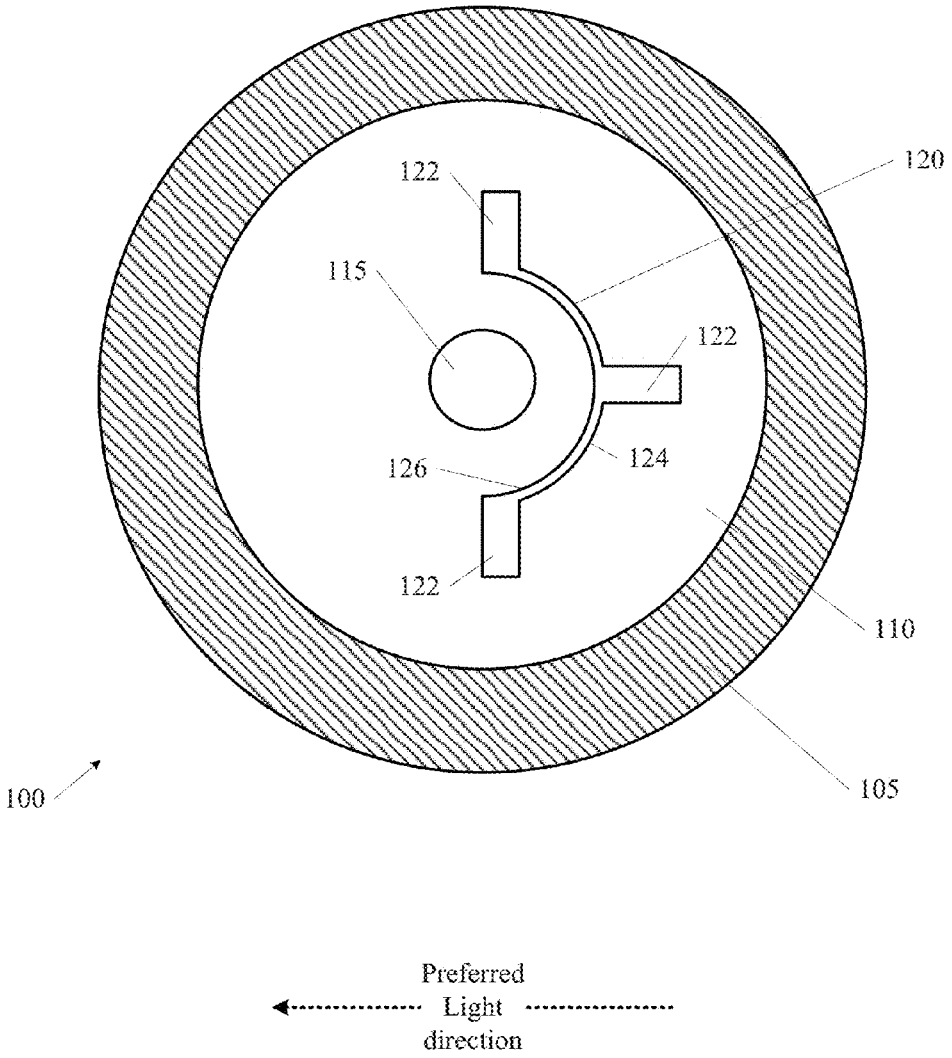
FIG. 5 shows a cross-section of still another alternative embodiment of an LED assembly.
Figure 6:
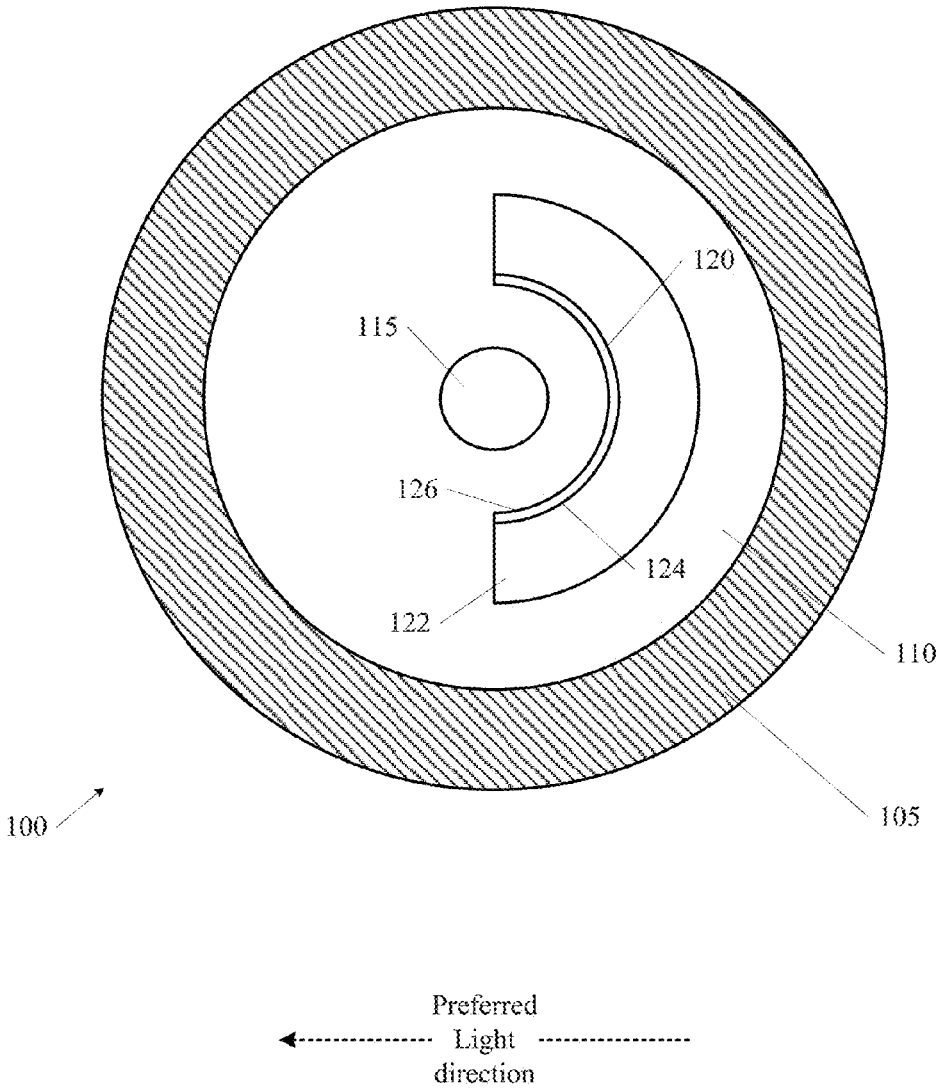
FIG. 6 shows a cross-section of yet another alternative embodiment of an LED assembly.

Embodiments of LED assembly 100 includes reflector 120 that is positioned within the void 110 so as to extend at least partially around the light emitter 115. Retention structure, such as tab 122, can be provided on reflector 120 and used to secure reflector 120 to circuit board 130 within LED assembly 100. The reflector 120 may include more than one tab 122 (see FIG. 5) or the tab may be a continuous tab that extends all the way or partially around the base of reflector 120, as shown in FIG. 6. The tab 122 can have any geometry that permits it to attach the reflector 120 to the circuit board 130. Moreover, any retention structure that permits the reflector 120 to be attached to the circuit board 130 may be used and certainly is not limited to the tab geometry disclosed herein.

Tab 122 can be secured to circuit board 130 using any attachment scheme, for example, using solder, a screw, staple, glue, adhesive, heat bonding, rivets, push tab connectors, slot tab connectors, etc. In some embodiments, reflector 120 can be coupled directly with the top surface of circuit board 130. Using these tabs 122, the reflector 120 is secured directly to circuit board 130 and not to lens 105. In some embodiments, for example, reflector 120 may not be in contact with lens 105.

In some embodiments reflector 120 can be secured to the circuit board using a light emitter holder (e.g., an LED COB array holder). A light emitter holder can be used to secure an LED to a circuit board or a substrate. Some LEDs are powered with contacts that are not soldered to a circuit board. Instead, a light emitter holder can be screwed to the circuit board in such a way to hold and secure the light emitter in place on the circuit board and to keep the necessary electrical contacts in place. Such a light emitter holder can be used to secure the reflector to the circuit board. For instance, the reflector can include tab 122 with a hole that is sized to correspond with the screw (or bolt) that secures light emitter holder into place. Tab 122 can be secured to the circuit board using the same screw that secures the light emitter holder. This screw can pass through the hole in tab 122. Reflector 120 can be placed above or beneath light emitter holder. In some embodiments, reflector 120 can pressed to the circuit board with the light emitter holder with or without the screw passing through tab 122.

Reflector 120 can have shape and/or dimension (e.g., height) that permits the reflector 120 to fit within void 110. In the illustrated embodiment of FIG. 1, the reflector 120 has a semi-circular shape so as to curve around light emitter 115 and azimuthally surround light emitter 115 around 180°. In other examples, reflector 120 can azimuthally surround light emitter 115 around 270°, 225°, 135°, 90°, etc. However, the reflector 120 is not limited to the illustrated semi-circular shape but rather can have any desired shape, including semi-oval or elliptical cross sectional shapes. In some embodiments, reflector 120 may include a continuous curve that wraps around light emitter 115.

While FIG. 1 illustrates the reflector 120 as having a consistent cross-sectional shape (i.e., an inner surface 126 and an outer surface 124 of the same shape), it need not. Rather, the inner surface 126 and outer surface 124 can be of different shapes. The inner surface 126 of the reflector 120 can be of any shape that effectuates the desired reflection of light in a preferred light direction, as discussed below. This includes, but is not limited to, an inner surface 126 having an elliptical, parabolic shape or irregular geometry. In some embodiments, reflector 120 can comprise a plurality of reflectors.

In some embodiments, reflector 120 does not only extend around the light emitter 115 but rather can also extend partially over the light emitter 115 so as to reflect nearly vertical light emitted by the light emitter 115.

The reflector 120 may be formed of any suitable material, including polymeric materials (e.g., optical grade polyesters, polycarbonates, acrylics, etc.) or metallic materials (e.g., prefinished anodized aluminum (e.g. Alanod Miro), prefinished anodized silver (e.g. Alanod Miro Silver), painted steel or aluminum, etc.). Regardless of the material from which the reflector 120 is formed, the inner surface 126 of the reflector should have a high surface reflectivity, preferably, but not necessarily, between 96%-100%, inclusive, and more preferably 98.5-100%, inclusive.

Reflector 120 is shaped and positioned relative to light emitter 115 to direct light from the light emitter 115 in a desired or preferred direction. In use, light emitted from light emitter 115 in a non-preferred direction impinges upon the inner surface 126 of reflector 120, which in turn reflects the light in the preferred direction. For example, light ray(s) 150 exits light emitter 115, hits the inner surface 126 of reflector 120, and is reflected back in the preferred light direction (as viewed from above). Again, the positioning of the reflector 120 within void 110 and the shape of the inner surface 126 of the reflector 120 can be controlled to achieve the desired directionality of the reflected light. In FIG. 4, light rays the light rays 150 are reflected back through thick lens portion 112 toward the preferred light direction. The thickness and/or shape of thick lens portion 112 may be dictated, for example, by the desired outward surface shape and/or any refracting requirements.

Figure 7:
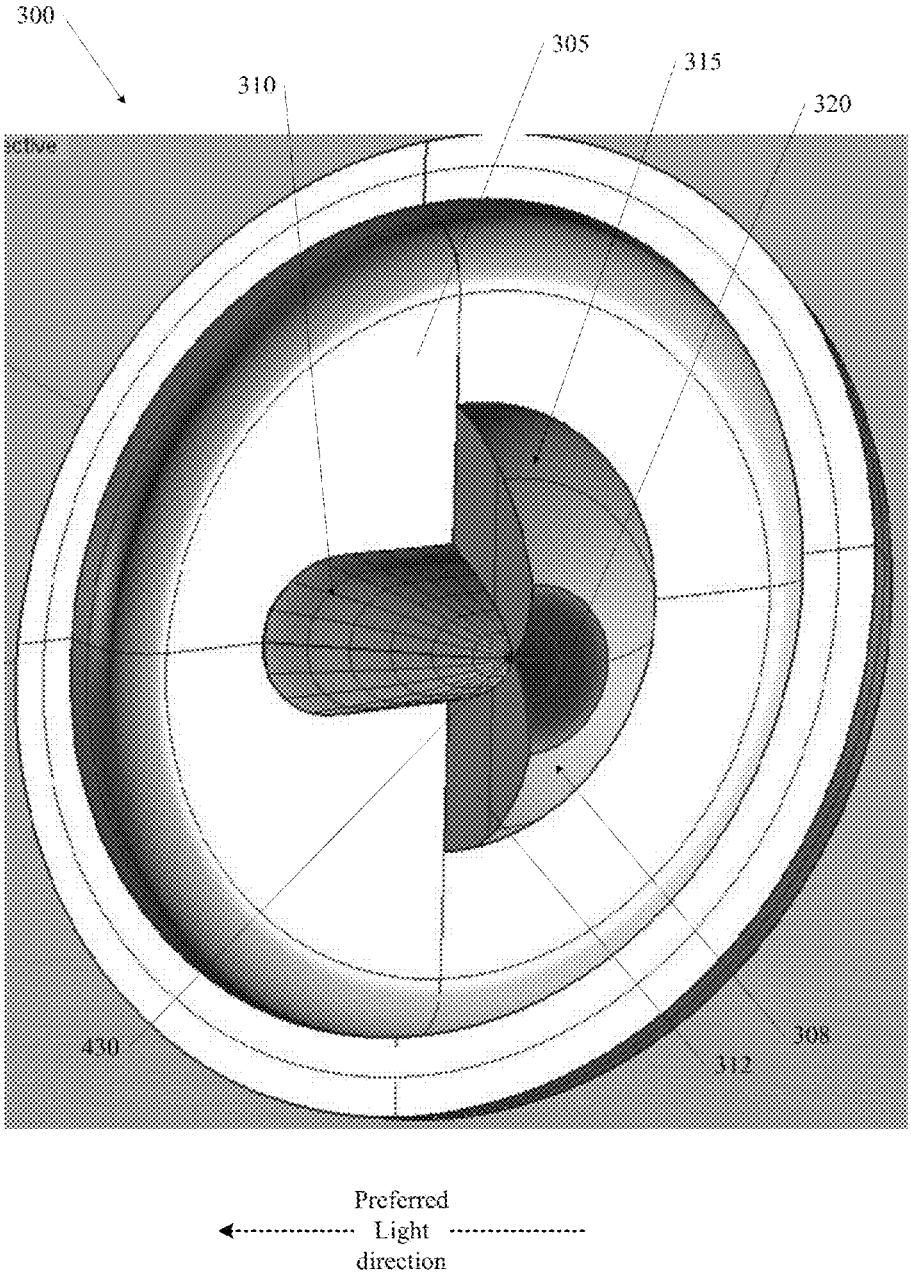
FIG. 7 shows a bottom perspective view of one embodiment of a lens for use in an embodiment of an LED assembly.

FIG. 7 shows the underside of lens 300 according to some embodiments of the invention. Lens 300 includes an outer surface and inner surface 305 that defines a lens cavity 308.

The lens cavity 308 can be formed so as to control the directionality of the light emitted from the lens 300.

The lens cavity 308 includes a preferred-side void 310 and non-preferred-side void 315. Each void 310, 315 can be of any shape and is certainly not limited to the geometries shown in the Figures. Non-preferred-side void 315 can have a semi-hemispherical cross-sectional shape or a semi-ovoid cross-sectional shape. Preferred-side void 310 can also have a semi-hemispherical cross-sectional shape or a semi-ovoid cross-sectional shape. Preferred-side void 310 can also have some linear portions or parabolic portions. The two voids 310 and 315 can be cut, etched, or molded into lens 300.

Lens 300 can be positioned over a light emitter or other light source. In some embodiments, the light emitter can be centrally disposed between the two voids 310 and 315. In other embodiments, the light emitter can be positioned in one or the other void 310 or 315.

An optical element 320 may also be provided in the lens cavity 308. The optical element 320 may be a separate component that is attached to the lens 300 within the lens cavity 308 or alternatively may be shaped when forming the lens cavity 308. The optical element 320 may have any desired shape not inconsistent with the objectives of the present invention to capture and direct light in a preferred light direction.

Figure 8:
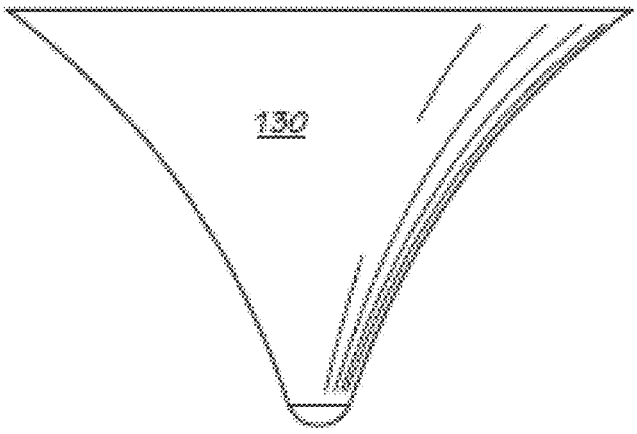
FIG. 8 shows a view of a shape geometry that an embodiment of an optical element can assume.
Figure 8A:
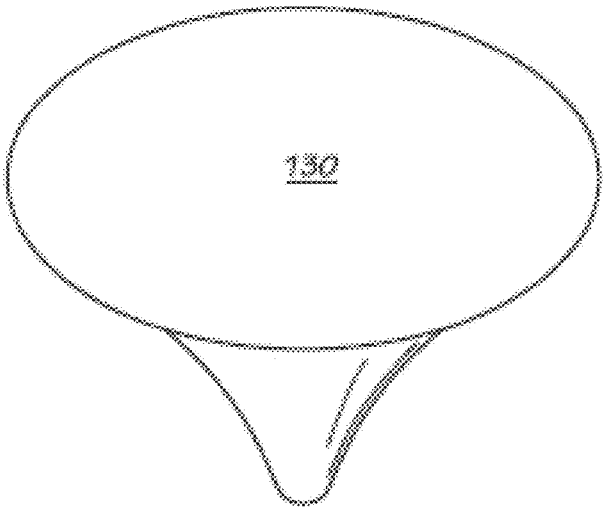
FIG. 8A shows a view of a shape geometry that an embodiment of an optical element can assume.
Figure 9:
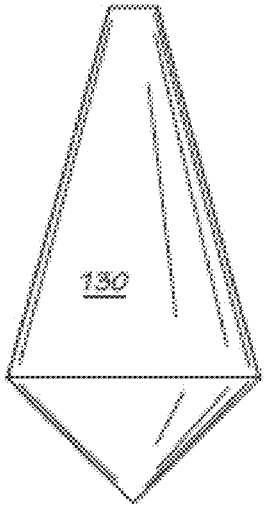
FIG. 9 shows a view of a shape geometry that an embodiment of an optical element can assume.
Figure 9A:
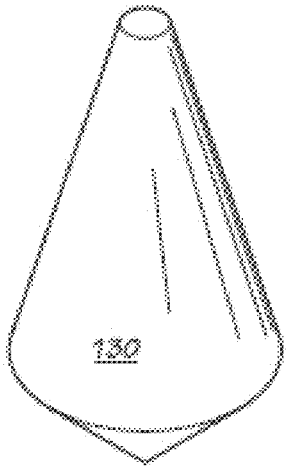
FIG. 9A shows a view of a shape geometry that an embodiment of an optical element can assume.
Figure 10:
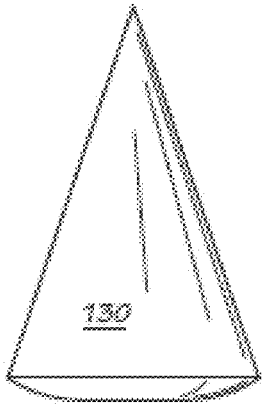
FIG. 10 shows a view of a shape geometry that an embodiment of an optical element can assume.
Figure 10A:
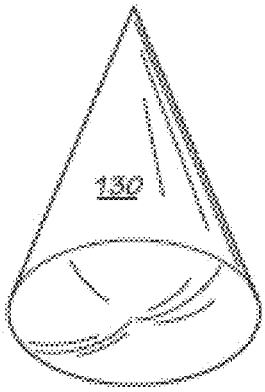
FIG. 10A shows a view of a shape geometry that an embodiment of an optical element can assume.
Figure 11:
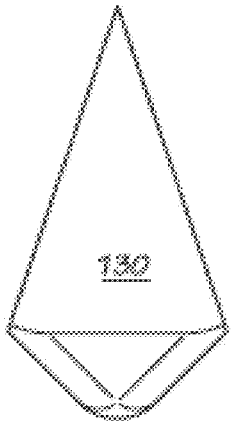
FIG. 11 shows a view of a shape geometry that an embodiment of an optical element can assume.
Figure 11A:
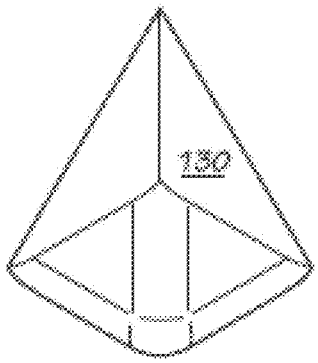
FIG. 11A shows a view of a shape geometry that an embodiment of an optical element can assume.
Figure 12:
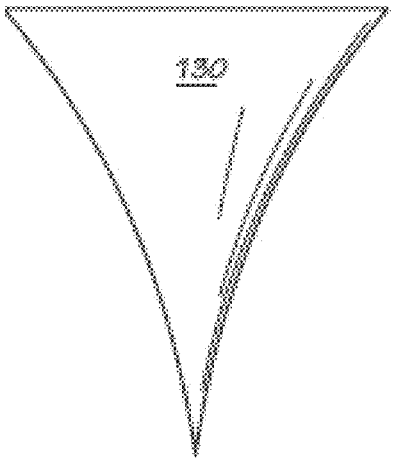
FIG. 12 shows a view of a shape geometry that an embodiment of an optical element can assume.
Figure 12A:
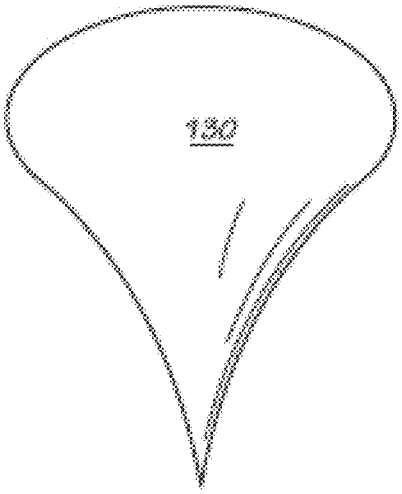
FIG. 12A shows a view of a shape geometry that an embodiment of an optical element can assume.
Figure 13:
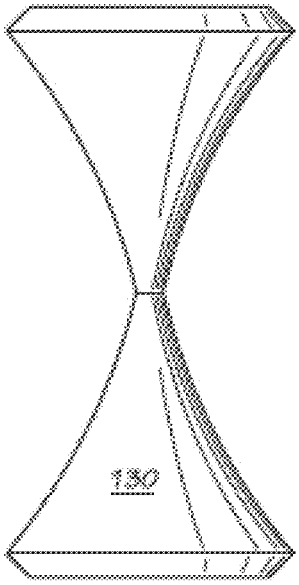
FIG. 13 shows a view of a shape geometry that an embodiment of an optical element can assume.
Figure 13A:
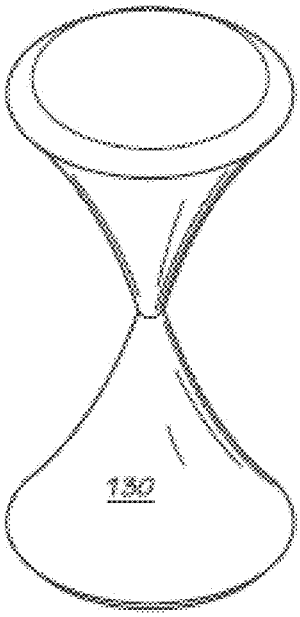
FIG. 13A shows a view of a shape geometry that an embodiment of an optical element can assume.
Figure 14:
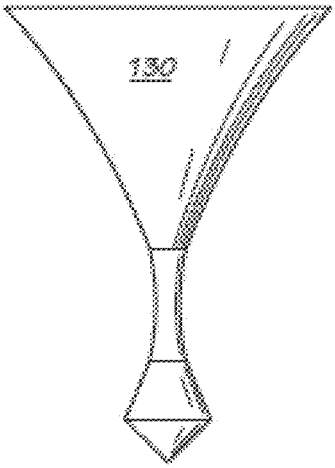
FIG. 14 shows a view of a shape geometry that an embodiment of an optical element can assume.
Figure 14A:
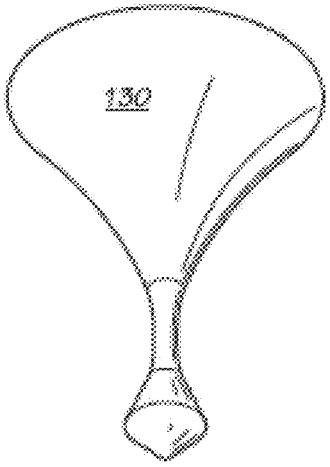
FIG. 14A shows a view of a shape geometry that an embodiment of an optical element can assume.

FIGS. 8-14 illustrate in isolation various non-limiting shape geometries that optical element 320 may assume according to some embodiments. In particular, the optical element 320 may include a conical shape with a tapered side and smooth distal tip (FIGS. 8 and 8A), a dual-conical shape (FIGS. 9 and 9A), a conical shape with a rounded base (FIGS. 10 and 10A), a dual-pyramidal shape (FIGS. 11 and 11A), a conical shape with a tapered side and pointed distal tip (FIGS. 12 and 12A), an hourglass shape (FIGS. 13 and 13A) or a modified hourglass shape (FIGS. 14 and 14A).

Figure 15:
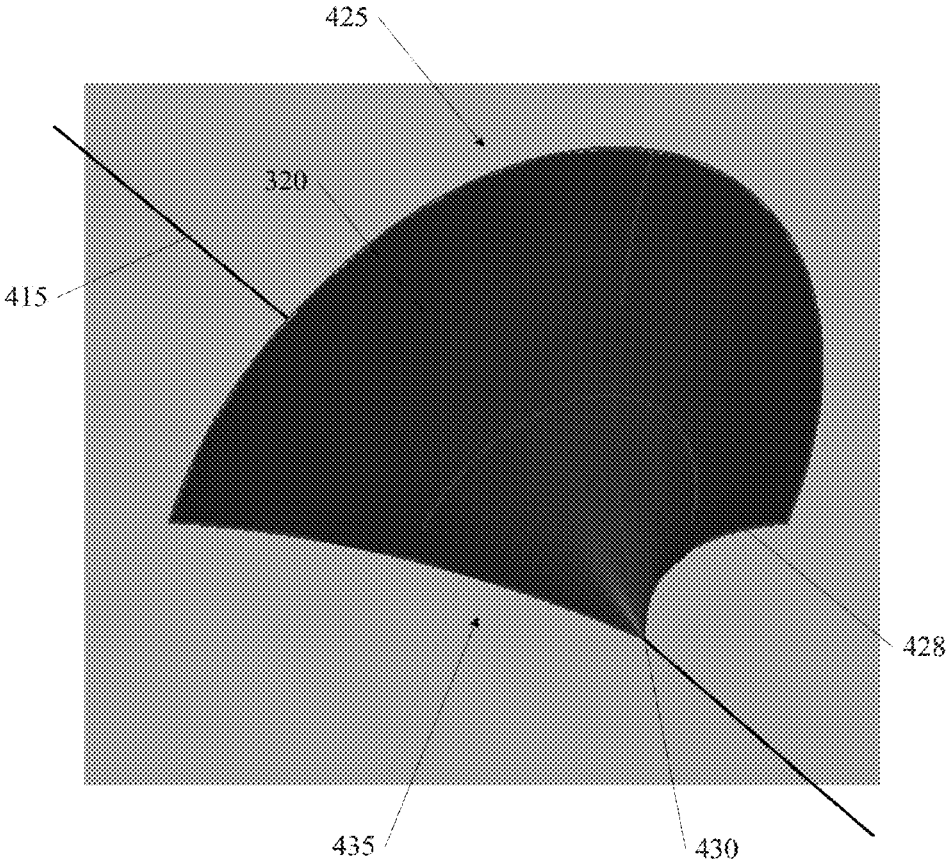
FIG. 15 is a bottom perspective view of an embodiment of an optical element in isolation.

Note, however, that the optical element 320 need not, and often will not, include the entirety of a shape geometry, such as those shown in FIGS. 8-14. For example, only a portion of such shapes may form the optical element 320 that is formed or otherwise provided in the lens cavity 308. FIG. 7 shows an embodiment of a lens 300 having an optical element 320 provided in the lens cavity 308, and FIG. 15 shows the optical element 320 of FIG. 7 in isolation. The optical element 320 of FIG. 15 has a substantially conical shape with an upper plane 425, a flat side wall 435, and a curved side wall 428 that tapers downwardly from the upper plane 425 into a distal tip 430. Axis 415 extends through tip 430. Optical element 320 of FIG. 15 is similar to the shape of FIG. 7 if such shape was sliced longitudinally down the middle (thereby creating flat side wall 435). Again, however, the optical element 320 may be of any shape and/or dimension. For example, upper plane 425 can azimuthally circumscribe a semi-circle or circle around axis 415. Upper plane 425 may also include an ellipse or semi-ellipse with axis 415 extending through one foci of the ellipse or through the center of the ellipse.

In some embodiments, at least one surface of the optical element 320 may be reflective. In some embodiments, such surface may have a surface reflectivity between 90%-99.5%, inclusive; possibly 93%-96%, inclusive; and more preferably 98.5%-99%, inclusive. Such reflectivity may be achieved by forming the optical element 320 from a highly reflective material or alternatively treating the surface of the optical element 320 so as to achieve such reflectivity.

As seen in FIG. 7, optical element 320 extends downwardly into the lens cavity 308. In some embodiments, axis 415 can be parallel with the axis of the light emitter and/or lens 305. In other embodiments, axis 415 and the light emitter axis can be the same axis and/or lens 305.

While certainly not required, at least a portion of optical element 320 may reside in the non-preferred-side void 315 (as shown in FIG. 7) so as to be available to redirect light emitted into the non-preferred-side void 315, as discussed below. In this embodiment, the flat side wall 435 of optical element 320 abuts the plane 312 that separates non-preferred-side void 315 and preferred-side void 310.

Figure 16:
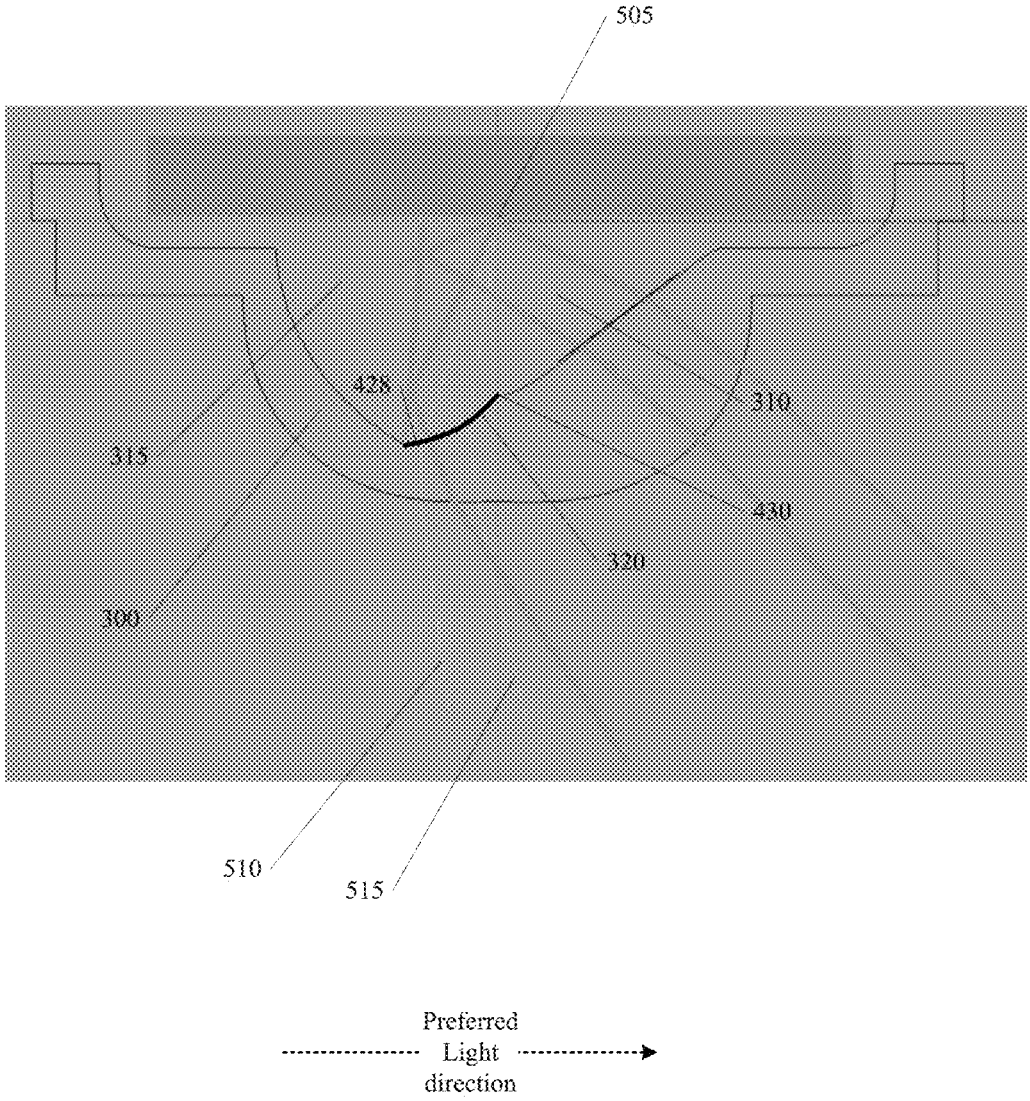
FIG. 16 is a cross-sectional view of the lens of FIG. 7 positioned over a light emitter.

As shown in FIG. 16, optical element 320 can direct light from a light source (e.g., LED) that is emitted into the non-preferred direction (i.e., in the non-preferred-side void 315) back toward the preferred light direction. Light emitter 505 can produce light following light rays 510 and 515. These light rays can pass through lens 300. In particular, these light rays pass through optical element 320. Light rays 510 and 515 are originally directed into non-preferred-side void 315 but impinge optical element 320 that, in turn, refracts light rays 510 and 515 so that they exit lens 300 in the preferred direction.

Figure 17:
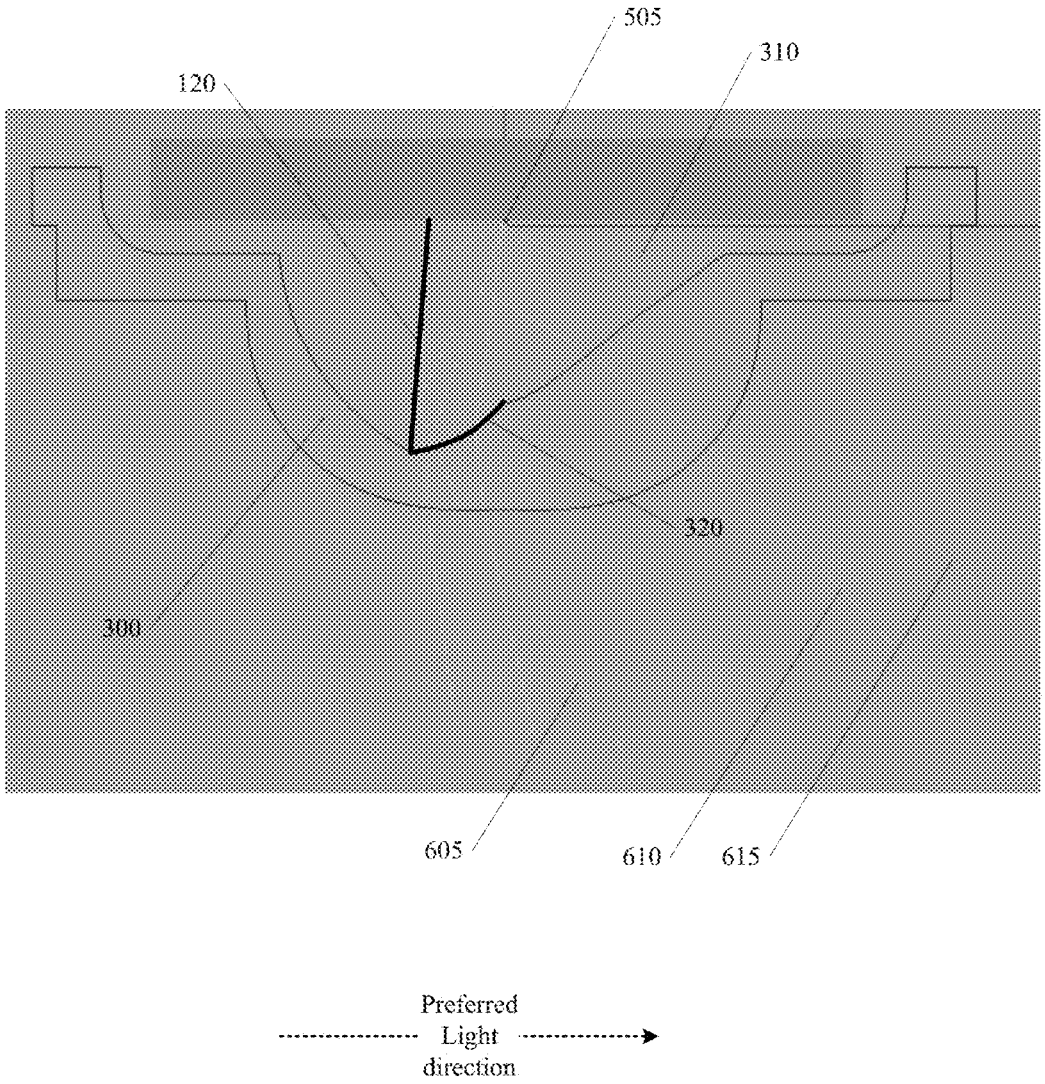
FIG. 17 is a cross-sectional view of an alternative embodiment of an LED assembly that includes the lens of FIG. 7 and a reflector.

FIG. 17 shows ray traces from a light emitter 505 emitted through lens 300 having both optical element 320 and reflector 120, according to some embodiments of the invention. In particular, light ray 605 is reflected off reflector 120 and is refracted via optical element 320. The combined reflection and refraction directs the light in the preferred light direction. As discussed above, in some embodiments reflector 120 is attached directly to a circuit board and is not supported by the lens.

Light rays 610 and 615 are refracted through lens 300 in the preferred light direction. Light ray 615 enters preferred-side void 310 prior to being refracted through lens 300. Light ray 610 is reflected off of reflector 120, enters preferred-side void 310, and exits after being refracted through lens 300.

Figure 18:
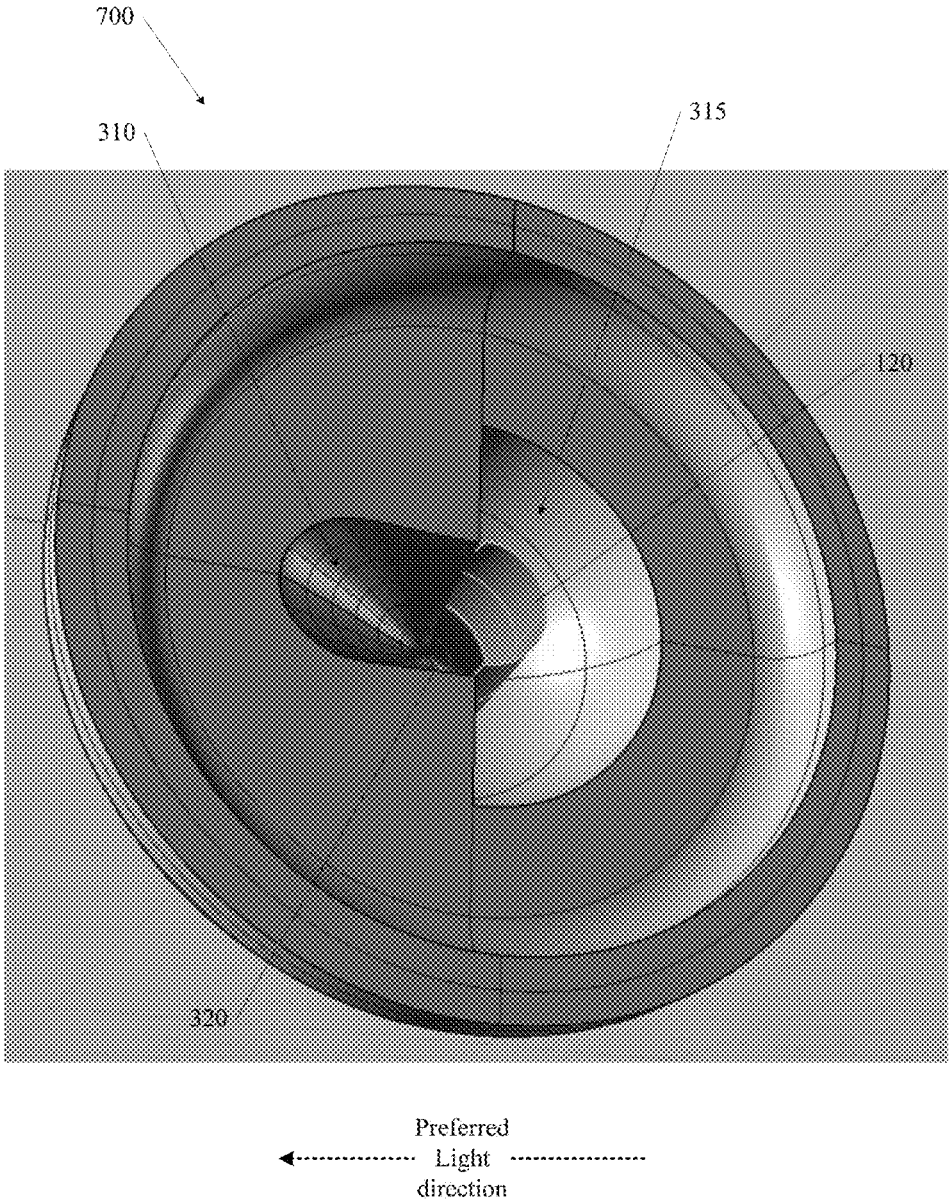
FIG. 18 is a bottom perspective view of the lens and reflector shown in FIG. 17.

FIG. 18 shows an embodiment of a lens 700 having curved reflector 120 and optical element 320 disposed within non-preferred-side void 315. Light may pass through either preferred side void 310 or optical element 320, depending on the longitudinal angle of incident on reflector 120. For example, high angle light (relative to the vertical axis of light emitter 505) will reflect off reflector 120 and exit through lens 700. Low angle light will reflect off reflector 120 and exit through optical element 320.

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below and not by the brief summary and the detailed description.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

What is claimed is:

1. A light assembly for distributing light in a preferred direction, the light assembly comprising:

a light emitter coupled with a substrate, the light emitter defining an emitter axis that is perpendicular to the substrate, a plane including the emitter axis dividing a preferred side from a non-preferred side; and a lens positioned over the light emitter and defining a lens cavity enclosed between the substrate and the lens, wherein for a first portion of light, defined as all light emitted by the light emitter that enters the lens cavity on the preferred side, the lens emits all of the first portion of light toward the preferred side without refracting any of the first portion of light toward the non-preferred side;

an optical element disposed within the lens cavity on the non-preferred side, wherein for a second portion of light, defined as all light emitted by the light emitter that both enters the lens cavity on the non-preferred side and first impinges on the optical element, the optical element refracts all of the second portion of light toward the preferred side without refracting any of the first portion of light toward the non-preferred side; and a reflector disposed within the lens cavity on the non-preferred side and arranged such that all of the light emitted by the light emitter that enters the lens cavity on the non-preferred side excluding the second portion of the light reflects from the reflector before impinging on the lens or the optical element, wherein for a third portion of light, defined as all light emitted by the light emitter that enters the lens cavity on the non-preferred side excluding the second portion of the light, the reflector reflects all of the third portion of light toward the preferred side;

such that all of the first, second and third portions of the light exit the lens toward the preferred side.

2. The light assembly of claim 1, wherein the substrate is a circuit board.

3. The light assembly of claim 1, wherein a subset of the third portion of light reflects toward the optical element, and wherein the optical element refracts the subset of the third portion of light so that the subset exits the lens in the preferred direction.

4. The light assembly of claim 1, wherein the optical element is formed integrally with the lens.

5. The light assembly of claim 1, wherein the optical element is separate from the lens, is disposed in contact with the lens and extends from the lens toward the light emitter.

6. The light assembly of claim 1, wherein the at least one optical element terminates in a tip that points from the lens toward the light emitter.

7. A light assembly for distributing light in a preferred direction, the light assembly comprising:

a light emitter coupled with a substrate, the light emitter defining an emitter axis that is perpendicular to the substrate, a plane including the emitter axis dividing a preferred side from a non-preferred side; and a lens positioned over the light emitter and defining a lens cavity enclosed between the substrate and the lens, wherein for a first portion of light, defined as all light emitted by the light emitter that enters the lens cavity on the preferred side, the lens emits all of the first portion of light toward the preferred side without refracting any of the first portion of light toward the non-preferred side;

an optical element disposed within the lens cavity on the non-preferred side, wherein:

the optical element is radially symmetric about the emitter axis, and for a second portion of light, defined as all light emitted by the light emitter that both enters the lens cavity on the non-preferred side and first impinges on the optical element, the optical element refracts all of the second portion of light toward the preferred side without refracting any of the first portion of light toward the non-preferred side; and a reflector disposed within the lens cavity on the non-preferred side and arranged such that all of the light emitted by the light emitter that enters the lens cavity on the non-preferred side excluding the second portion of the light reflects from the reflector before impinging on the lens or the optical element, wherein for a third portion of light, defined as all light emitted by the light emitter that enters the lens cavity on the non-preferred side excluding the second portion of the light, the reflector reflects all of the third portion of light toward the preferred side;

such that all of the first, second and third portions of the light exit the lens toward the preferred side.

8. A light assembly for distributing light in a preferred direction, the light assembly comprising:

a light emitter coupled with a substrate, the light emitter defining an emitter axis that is perpendicular to the substrate, a plane including the emitter axis dividing a preferred side from a non-preferred side; and a lens positioned over the light emitter and defining a lens cavity enclosed between the substrate and the lens, wherein for a first portion of light, defined as all light emitted by the light emitter that enters the lens cavity on the preferred side, the lens emits all of the first portion of light toward the preferred side without refracting any of the first portion of light toward the non-preferred side;

an optical element disposed within the lens cavity on the non-preferred side, wherein:

wherein the optical element forms a tip and defines an axis of symmetry that extends through the tip, the axis of symmetry extends parallel to but is offset from the light emitter axis, and for a second portion of light, defined as all light emitted by the light emitter that both enters the lens cavity on the non-preferred side and first impinges on the optical element, the optical element refracts all of the second portion of light toward the preferred side without refracting any of the first portion of light toward the non-preferred side; and a reflector disposed within the lens cavity on the non-preferred side and arranged such that all of the light emitted by the light emitter that enters the lens cavity on the non-preferred side excluding the second portion of the light reflects from the reflector before impinging on the lens or the optical element, wherein for a third portion of light, defined as all light emitted by the light emitter that enters the lens cavity on the non-preferred side excluding the second portion of the light, the reflector reflects all of the third portion of light toward the preferred side;

such that all of the first, second and third portions of the light exit the lens toward the preferred side.

9. The light assembly of claim 1, wherein the reflector extends at least partially around the light emitter.

10. A light assembly comprising:

a substrate;

a light emitter supported on the substrate and having an emitter axis oriented outwardly from and normal to the substrate, wherein a preferred-side and a non-preferred-side are separated by a plane that includes the emitter axis;

a lens positioned over the light emitter, the lens comprising:

an outer surface, and an inner surface, wherein a void exists between the light emitter and the inner surface;

an optical element, disposed exclusively on the non-preferred-side and within the void, that is shaped to refract light that is emitted from the light emitter directly toward the optical element, so that the refracted light exits the lens toward the preferred side; and a reflector, coupled with the substrate and disposed within the void on the non-preferred-side, that reflects light that is emitted from the light emitter directly toward the reflector so that the reflected light exits the lens toward the preferred side.

11. The light assembly of claim 10, wherein the optical element is formed separately from the lens.

12. A light assembly comprising:

a substrate;

a light emitter supported on the substrate and having an emitter axis oriented outwardly from and normal to the substrate, wherein a preferred-side and a non-preferred-side are separated by a plane that includes the emitter axis;

a lens positioned over the light emitter, the lens comprising:

an outer surface, and an inner surface, wherein a void exists between the light emitter and the inner surface;

an optical element, disposed exclusively on the non-preferred-side and within the void, that is shaped to refract light that is emitted from the light emitter directly toward the optical element, so that the refracted light exits the lens toward the preferred side, wherein the optical element comprises a flat side wall that is disposed along the plane; and a reflector, coupled with the substrate and disposed within the void on the non-preferred-side, that reflects light that is emitted from the light emitter directly toward the reflector so that the reflected light exits the lens toward the preferred side.

13. The light assembly of claim 10, wherein the optical element and the reflector are arranged such that all light emitted by the light emitter on the non-preferred side impinges first upon either the optical element or the reflector.

14. A light assembly comprising:

a substrate;

a light emitter supported on the substrate and having an emitter axis oriented outwardly from and normal to the substrate, wherein a preferred-side and a non-preferred-side are separated by a plane that includes the emitter axis;

a lens positioned over the light emitter, the lens comprising:

an outer surface, and an inner surface, wherein a void exists between the light emitter and the inner surface;

an optical element, disposed exclusively on the non-preferred-side and within the void, that is shaped to refract light that is emitted from the light emitter directly toward the optical element, so that the refracted light exits the lens toward the preferred side, wherein the optical element comes to a point along the emitter axis and in the plane; and a reflector, coupled with the substrate and disposed within the void on the non-preferred-side, that reflects light that is emitted from the light emitter directly toward the reflector so that the reflected light exits the lens toward the preferred side.

15. The light assembly of claim 14, wherein the optical element forms a curved surface from the inner surface to the point, the curved surface being concave with respect to the light emitter.

16. A light assembly for emitting light toward a preferred side, the light assembly comprising:

a substrate;

a light emitter coupled with the substrate and having an emitter axis that lies within a plane that forms a boundary between the preferred side and a non-preferred side; and a lens positioned over the light emitter, the lens comprising:

an outer surface, and an inner surface, wherein:

a void exists between the inner surface of the lens and the light emitter, a first portion of the inner surface, on the non-preferred side, is inwardly concave with respect to the light emitter, and a second portion of the inner surface, on the non-preferred side, is an axially inward protrusion, from the first surface portion toward the light emitter, and forms a tip at the emitter axis, the second surface portion being radially symmetric about the emitter axis, and radially proximal to the emitter axis with respect to the first surface portion of the inner surface; and a reflector coupled to the substrate and disposed within the void adjacent to, but not in contact with, the light emitter, where the reflector curves at least partially around the light emitter azimuthally relative to the emitter axis and is adapted to reflect light emanating from the light emitter toward the non-preferred side so that the reflected light exits the lens toward the preferred side.

17. The light assembly of claim 16, wherein the second portion of the inner surface comprises a curved surface between the first portion of the inner surface and the tip.

18. The light assembly of claim 16, wherein light from the light emitter that is directed toward the non-preferred side and impinges on the second portion of the inner surface is refracted by the second portion toward the preferred side.

19. The light assembly of claim 16, wherein the reflector is disposed in continuous contact with the lens along a boundary between the first and second portions of the inner surface.

20. The light assembly of claim 16, wherein a portion of the inner surface, on the preferred side, forms a recess that is concave with respect to the light emitter.

* * * * *